US005282010A

United States Patent [19]

Popovic

[11] Patent Number: 5,282,010

[45] Date of Patent: Jan. 25, 1994

[54] STRIPPING OF PAPER FROM PHOTORECEPTOR BELTS WITH REDUCED STRESS

[75] Inventor: Zoran D. Popovic, Mississauga, Canada

[73] Assignee: Xerox Corporation, Stamford, Conn.

[21] Appl. No.: 35,773

[22] Filed: Mar. 23, 1993

[51] Int. Cl.[5] ..... G03G 15/00

[52] U.S. Cl. ..... 355/315; 271/308; 355/212

[58] Field of Search ..... 355/212, 309, 315; 271/307, 308, 311, 900; 198/834, 842, 843

[56] References Cited

U.S. PATENT DOCUMENTS

| | | | |
|---|---|---|---|
| 3,966,199 | 6/1976 | Silverberg | 271/275 |
| 3,976,375 | 8/1976 | Kurita et al. . | |
| 3,984,183 | 10/1976 | Maksymiak | 271/188 X |
| 3,998,536 | 12/1976 | Kaupp . | |
| 4,072,307 | 2/1978 | Knieser | 271/174 |
| 4,751,547 | 6/1988 | Foratangelo | 355/315 X |
| 4,972,231 | 11/1990 | Bares | 355/251 |
| 4,987,456 | 1/1991 | Snelling et al. | 355/273 |
| 5,049,948 | 9/1991 | Brown et al. | 355/319 |
| 5,073,793 | 12/1991 | Fujiwara et al. | 355/202 |
| 5,081,500 | 1/1992 | Snelling | 355/273 |
| 5,099,286 | 3/1992 | Nishise et al. | 355/272 |
| 5,164,777 | 11/1992 | Agarwal et al. | 355/212 |
| 5,177,543 | 1/1993 | Rodenberg et al. | 355/271 |

*Primary Examiner*—A. T. Grimley
*Assistant Examiner*—Thu Dang

[57] ABSTRACT

In an electrophotographic printer, an improved system for stripping copy sheets from a photoreceptor imaging belt which may be adversely life affected by mechanical wrapping stresses from wrapping around small radii supports over time, yet with the copy sheets desirably stripping from the photoreceptor belt at a small radius arcuate sheet stripping area of the photoreceptor belt; by mounting the belt only on large diameter supports which do not wrap the belt in any small radii; and temporarily engaging only during copy sheet printing the inside surface of the belt with a small radius stripping member with sufficient force to only temporarily arcuately slightly deform the photoreceptor belt in a correspondingly small radius so as not to introduce substantial long lasting mechanical wrapping stresses in the belt but to define the desired small radius sheet stripping area.

16 Claims, 1 Drawing Sheet

STRIPPING OF PAPER FROM PHOTORECEPTOR BELTS WITH REDUCED STRESS

Figure 1:
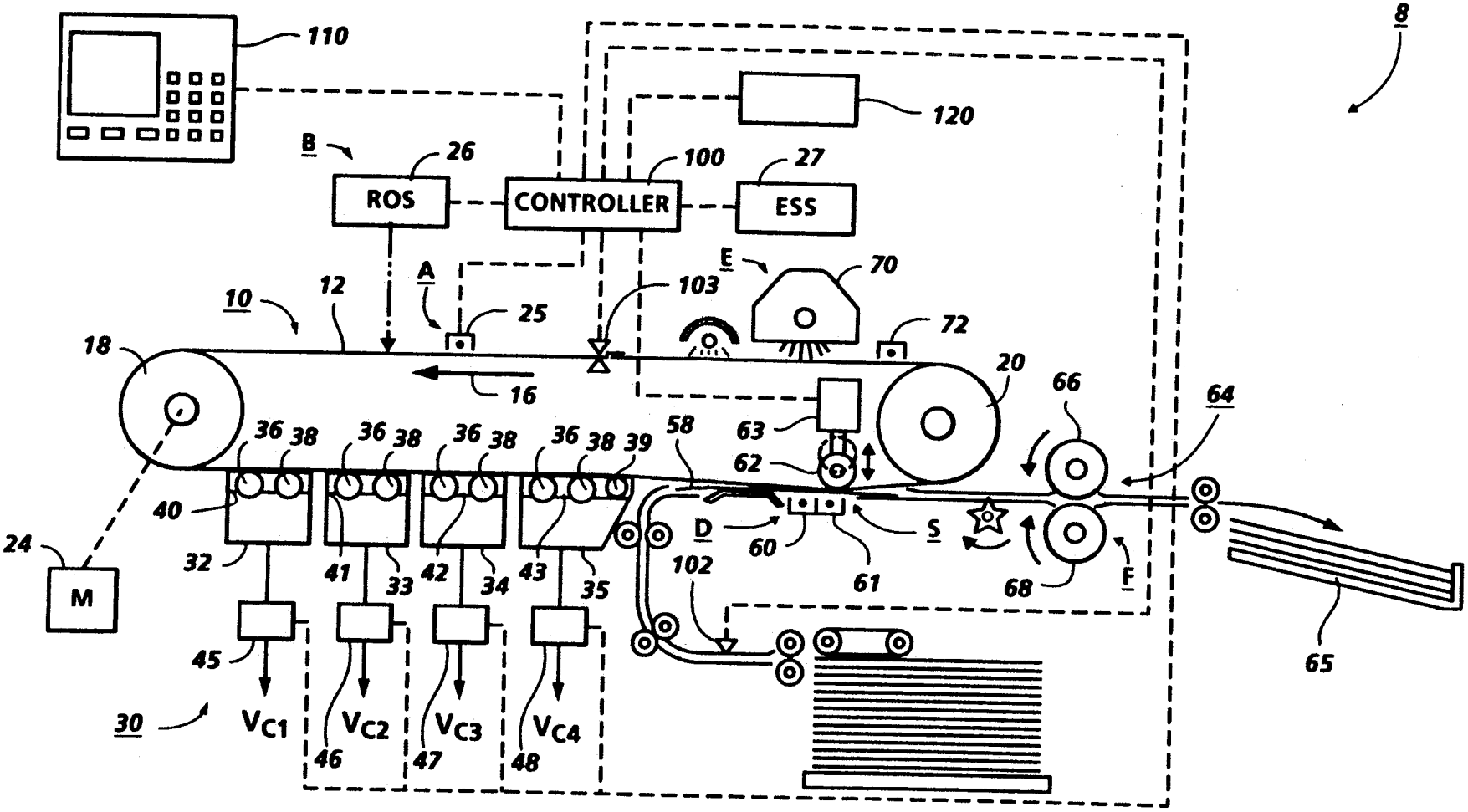

Disclosed is an improved system for effectively assisting stripping of copy sheets from belt imaging surfaces, yet also reducing mechanical stresses of the imaging belt.

There is disclosed herein an improved system for extending the effective photoreceptor belt life in electrostatographic reproducing machines by reducing the amount of stress over time of the photoreceptor belt, yet without sacrificing the well known advantages of deformation of the photoreceptor belt in a small radius for copy sheet stripping assistance, or sheet self-stripping by sheet beam strength.

Photoreceptor belts of copiers or printers are particularly susceptible to stresses from deflections over long time periods because of their specialized photosensitive materials, especially belts with plural layers of different materials. Photoreceptor belt properties are necessarily maximized for imaging properties, etc., not stress resistance, unlike drive belts. Some examples of Xerox Corporation U.S. patents discussing the problems of organic photoreceptor belt flexibility and delamination from the small diameter belt supporting rollers desired for copy sheet self-stripping (and/or for very small machines) include U.S. Pat. Nos. 4,265,990; 4,937,117 and 4,786,570. Typical organic photoreceptors are particularly susceptible to stress at the belt seam, where the two ends of the belt are welded or glued together to make the belt loop.

As xerographic and other copiers and printers increase in speed and workloads, and become more automatic, it is increasingly important to provide longer life and more reliable operation, and also to provide improved handling of the copy sheets. These sheets may have a variety of mixture of sizes, types, weights, materials and conditions. Yet it is very desirable to provide improved, minimal, misstripping or jamming rates, especially for unattended or remote printers.

The particular problems of stripping copy sheets from imaging surfaces after electrostatic toner image transfer are well known in the art. Various types of sheet stripping and/or detacking systems are known in the xerographic copier and printer art. The following patent disclosures provide some examples. An effective combination of detack neutralizing plus small radius arcuate deformation of the photoreceptor away from the sheet for improved paper beam strength self-stripping is well established in the art as the most desirable solution, used in most copier and printer products. The basic detack and sheet beam strength stripping patent is Xerox Corporation U.S. Pat. No. 3,998,536, issued Dec. 21, 1976 to Norbett H. Kaupp, originally filed Oct. 11, 1966. Recent Eastman Kodak U.S. Pat. No. 5,177,543 further discusses continuing sheet stripping problems in the art from photoreceptor belts, and suggests an [undesirable] increase in background toner contamination to try to avoid such miss-strips. Another teaching of, and suggestion for, this problem is in Xerox Corporation U.S. Pat. No. 3,984,183, issued Oct. 5, 1976 to John Maksymiak. That U.S. Pat. No. 3,984,183 teaches deforming a belt photoreceptor over a transversely crowned (barrel shaped) supporting roller for additional sheet beam strength for stripping assistance. However, that has certain potential disadvantages discussed therein, and would exacerbate the stress problems addressed here, and is not known to be commercially used.

The problem created by the conventional usage of a small diameter sheet stripping roller to support at least one end or corner of a photoreceptor belt, of about 25 mm or less in diameter is that the constant running over, or stopping on, such a fixed small diameter roller causes stresses in the belt which over time can cause fatigue or other failures of the belt materials. That is, photoreceptor belt usage with the desired small diameter stripping roller can cause belt deformation, cracking or the above-noted layer separations over time. That problem would be even worse if the belt wrap diameter were uncompromisingly optimized for stripping, e.g., made 19–20 mm or less.

Of mechanical background interest is Xerox U.S. Pat. No. 4,972,231, issued Nov. 20, 1990 to Jan Bares. Col. 7, lines 8–16 thereof describe photoreceptor backing idler rollers 40 for partially wrapping the photoreceptor belt (upon actuation with solenoid 78) concavely about a portion (about 5° to about 25°) of the surface of a tubular developer roller, for image development. This obviously could not provide copy sheet stripping. [Although not shown therein, there might inherently also be some convex belt deformation around these idler rollers 40.]

A specific feature of the specific embodiment(s) disclosed herein is to provide, in an electrographic printing system, an improved system for stripping copy sheet image substrates from a photoreceptor imaging belt, which photoreceptor belt may be adversely life affected by mechanical wrapping stresses from wrapping the photoreceptor belt around small radii supports over time, and wherein said printing system has a sheet stripping area in which said copy sheet imaging substrates are desirably stripped from said photoreceptor belt at a small radius arcuate sheet stripping area of said photoreceptor belt, the improvement comprising: operatively mounting the photoreceptor belt in said printing system only on relatively large radius supports which do not wrap the belt in any small radii; automatically temporarily engaging the inside surface of the photoreceptor belt only during copy sheet printing with a small radius stripping member, of a smaller radius than said large radius supports, with sufficient engagement force to temporarily arcuately deform a small arc segment portion of said photoreceptor belt in a correspondingly small radius to define said desired small radius sheet stripping area at said small portion of said photoreceptor belt so deformed by said small radius stripping member; and automatically removing said small radius stripping roller from said deforming engagement with said photoreceptor belt when said photoreceptor belt is not being used for said copy sheet image substrates so as not to introduce substantial said long lasting mechanical wrapping stresses in said photoreceptor belt.

Further specific features provided by the system disclosed herein, individually or in combination, include those in which said small radius stripping member temporarily deforms said photoreceptor belt in said sheet stripping area by only about 5 mm or less and much less than 45 degrees, from a linear bight portion of said photoreceptor belt; and/or wherein said small radius stripping member is moved into said temporary engagement with said photoreceptor belt only when said electrophotographic printing system is operating with said photoreceptor belt rotating; and/or wherein said small radius stripping member is moved into said engagement with said photoreceptor belt only when a copy sheet image substrate to be stripped is approaching said sheet stripping area; and/or wherein said large radius belt supports comprise two large diameter rollers both having larger radii than said small radius stripping member (preferably more than about 25 mm diameter); and/or wherein said stripping is provided after being at least partially charge neutralized by detacking means; and/or wherein said small radius stripping member is a roller having a diameter of less than approximately 20 mm (preferably about 19–20 mm); and/or wherein said small radius stripping roller is automatically disengaged from said photoreceptor belt whenever a belt seam passes said sheet stripping area.

In the description herein the term "sheet" or "copy sheet" refers to a usually flimsy sheet of paper, plastic, or other such conventional individual image substrate to which the desired image is being transferred.

The disclosed apparatus may be readily operated and controlled in a conventional manner with conventional control systems. Some additional examples of various prior art copiers with control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems. As shown in the above-cited art, the control of copy sheet handling systems may be accomplished by conventionally actuating them by signals from the copier controller directly or indirectly in response to simple programmed commands. The Federal Circuit has held that where a microprocessor is generally indicated in the specification, one skilled in the art would know how to perform the necessary steps or desired functions described in the specification, and is not required to disclose actual software or "firmware" for disclosure support. In re *Hayes Microcomputer Products Inc. Patent Litigation*, 25 USPQ 2d 1241, (CA FC Dec. 23, 1992).

All references cited in this specification, and their references, are incorporated by reference herein where appropriate for appropriate teachings of additional or alternative details, features, and/or technical background.

As to specific hardware components of the subject apparatus, it will be appreciated that, as is normally the case, some such specific hardware components are known per se in other apparatus or applications, such as in the references cited herein.

Various of the above-mentioned and further features and advantages will be apparent from the specific apparatus and its operation described in the example below, as well as the claims. Thus, the present invention will be better understood from this description of one embodiment thereof, including the drawing figure wherein:

The Figure (FIG. 1) is a schematic side view of one embodiment of the present system incorporated in one example of a xerographic apparatus.

Describing now in further detail the exemplary embodiment with reference to the Figure, there is shown an electronic plural color printer type of reproducing machine 8, merely by way of one example of the application of the present invention. However, the present system can be used with any copier or printer with a belt imaging surface or even with an intermediate image transfer belt.

The Figure schematically depicts the various components of the illustrative electrophotographic printing machine 8. It conventionally employs an endless belt imaging surface member 10, e.g., a charge retentive member, typically having a photoconductive imaging surface 12 layer or layers on a conductive supporting substrate. It may be a well known organic photoreceptor, which, as indicated in above-cited patents, may comprise integral layers such as adhesive or blocking layers, photogenerating layers, charge transport layers, and even an overcoating layer. Alternatively, the belt 10 may be an equally well known selenium alloy on a conductive substrate, such as a (electrically grounded) nickel belt. Belt 10 here is entrained about and supported by and between a drive roller 18 and a tensioning roller 20.

The imaging belt 10 moves around rollers 18 and 20 in the direction of arrow 16 to advance successive portions thereof sequentially through the various processing stations disposed about the path of movement thereof, as will be described. Here, motor 24 conventionally rotates roller 18 to drive belt 10. If desired, as is known in the art, idler roller 20 may be replaced with a TEFLON® coated or other low friction skid plate providing a corresponding belt wrap radius.

It is important to note that here both of these belt 10 supporting rollers 18 and 20 here are of larger diameters than the diameters desirable for effective sheet stripping to avoid stressing the belt 10. Belt support diameters greater than about 25 mm provide a large enough belt wrap radius to give significant belt life improvement. A 50 mm or larger diameter is even better, and can provide a dramatic increase in belt life improvement. Thus, here no belt supporting rollers or arcuate belt guide surfaces provide the usual small belt wrap radius appropriate for copy sheet stripping from the belt 10. One of these supporting rollers 18 and 20 may also desirably have an elastomeric surface, and/or be spring-loaded and slightly movable, so as to tension the belt 10, yet allow a small amount of belt deflection without stretching the belt. Conventionally, a timing or registration mark or aperture is provided on the belt 10 to be sensed by a sensor, such as 103. This mark is also conventionally used to prevent attempted imaging on the belt seam, shown here adjacent to sensor 103.

Describing the conventional xerographic reproduction system here, initially successive portions of belt 10 pass through charging station A, where a corona generating device 25 charges the belt 10 outer surface to a high uniform negative [or positive] potential.

Next, the charged photoconductive surface 12 is advanced by the belt 10 movement through exposure station B, where it is exposed to a laser output scanning device 26, which causes the charge retentive surface to be selectively light-discharged to form latent images in accordance with the control of the laser beam output. Preferably, the scanning device 26 is a variable power level laser Raster Output Scanner (ROS). Alternatively, the ROS could be replaced by an LED array, or a conventional xerographic exposure device, as described in various of the above-cited patents. The ROS 26 of this machine 8 is driven by imaging or video signals from an electronic signal source unit 27 (ESS), which can be, or include, a computer or computer terminal, an electronic document scanning device or the like, facsimile, or other systems inputs.

At development station C, image(s) development system 30 brings developer materials into contact with the electrostatic latent images. The development system 30 here comprises first, second, third and fourth substantially identical developer housing or units 32, 33, 34 and 35. Preferably, each of these developer units includes magnetic brush developer rollers such as 36 and 38. The developer unit 32 contains toner developer material 40 of a first color (e.g., magenta). Developer unit 33 contains toner material 41 a second color (e.g., cyan), and developer unit 34 contains toner material 42 a third color (e.g., yellow). Finally, the developer housing 35 contains toner material of the fourth color (e.g., black). This last developer unit 38 may also provide a carrier scavenging or bead pick-off roller 39, closely adjacent the belt 10. Each pair of rollers 36 and 38 advances its respective developer material into contact with the latent image. Appropriate developer housing biasing ($V_{c1}$ for housing 32, $V_{c2}$ for housing 33, $V_{c3}$ for housing 34 and $V_{c4}$ for housing 35) is accomplished via power supplies 45, 46, 47, and 48 electrically connected to the respective developer units 32, 33, 34, and 35. Color discrimination in the development of the electrostatic latent image may be achieved by moving the latent image(s) recorded on the photoconductive surface 12 past the developer units 32, 33, 34 and 35 in a single pass with the housings of the developer units 40 electrically biased to voltages which are appropriately offset from the background voltage on the photoreceptor surface.

Especially since the composite image developed on the photoreceptor may consist of both positive and negative toner, a pre-transfer corona generating device (not shown) may conventionally be provided next to condition the toner for effective transfer. It will also be understood that an air knife, further bead pick-off and/or other apparatus may be positioned along the belt 10 between the developer station C and the transfer station D to remove undesirable materials from the belt.

For image transfer, a sheet of image substrate support material, here copy sheet 58, is moved into contact with the toner image at an otherwise conventional transfer station D. The sheet 58 is advanced to transfer station D by conventional sheet feeding apparatus, such as the illustrated feed belt contacting the uppermost sheet of a stack of clean copy sheets. The sheet feeder advances the uppermost sheet from the stack into a chute or baffle which directs the advancing sheet 58 into contact with the photoconductive surface 12 of belt 10 in a registered or timed sequence so that the toner powder image developed thereon contacts the advancing sheet of support material at transfer station D in registration.

Transfer station D conventionally includes a transfer corona generating device 60 which sprays ions of a suitable polarity onto the backside of sheet 58. This attracts the toner powder image from the belt 10 onto sheet 58. After transfer, the sheet 58 continues to move on the photoreceptor surface under detacking (neutralizing) corona source 61 into stripping station S.

In the present system, at that point in time, the belt 10 is unconventionally temporarily slightly deformed at stripping station S from its normal planar position there by approximately 5 mm or more by a small diameter (small radius) roller 62 cammed (moveably operated) by a solenoid 63 or other suitable mechanism. Roller 68 is cammed into the inside of belt 10 only when it is needed for stripping. This small radius roller 62 may also be elastomeric. When a sufficiently small diameter roller 62 (preferably 19–20 mm, or smaller) is used to deform (partially wrap around it) the photoreceptor belt to that small radius, self-stripping of paper will usually be achieved, especially with the detacking corona source 61.

As taught above, the disadvantage of using such small belt deforming rollers for self-stripping are large strains introduced into the photoreceptor belt structure which can lead to a significantly shortened belt life. The system here achieves such desired self-stripping of paper but at the same time, reduces significantly the average mechanical stress introduced in the photoreceptor belt by only temporarily slightly bending the belt around a retractable small diameter roller 62, as shown in the Figure, then retracting this small roller 62 (note the associated movement arrow) to restore the belt 10 to an unstressed planar configuration, in which the belt is only wrapped around two [or three] much larger diameter belt supports such as 18 and 20.

This small roller 62 is positioned (moved) by solenoid 63 for stripping so that that the photoreceptor belt 10 changes its direction by a small angle when passing over roller 62 by the roller 62 pressing into the back (inside) of the belt 10. If this wrap angle is sufficient, paper self-stripping will occur. The wrap angle here is much less than 45 degrees. In fact, a belt deformation of only about 5 mm or more from its normal planar position may be sufficient for stripping, which causes only a few degrees of wrap angle. Although a roller such as 62 is preferred, a low friction, correspondingly small radius, e.g., wedge shaped, non-rotating member might provide the same function.

The strain introduced in the photoreceptor depends on the diameter of this small roller 62. However for a given photoreceptor belt speed, the time of the application of this strain also depends on the bending angle of the photoreceptor. Therefore, the induced stress time product will be greatly reduced by employing the disclosed configuration as compared with the normal configuration, in which a 90 degree to 180 degree bend of the photoreceptor over a small fixed roller is utilized. I.e., this decrease of the belt bending angle here can further increase the belt life.

The primary avoidance of excessive fatigue of the photoreceptor belt here from its contact with the small roller 62 is that, whenever the belt 10 it is not moving, the small roller 62 is automatically retracted away from the belt. Furthermore, alternatively, the small roller 62 can be brought into contact with the photoreceptor only for the brief time periods when paper stripping is actually needed, thus further reducing the time periods of large induced stress in the photoreceptor belt.

The belt stress depends primarily on the radius of curvature and is therefore substantially the same for small or large wrap angles, although the longer the wrap, the longer the stress is applied. What is most ificantly different here is the time of application of stress. By having the small radius belt deflection (of small wrap angle) only during operation of the stripping roller camming mechanism 63, the stress is applied for a much shorter time during belt cycling. Such stress is entirely absent when the machine 8 is not running, as the small diameter roller 62 is then moved completely away from the belt photoreceptor.

As noted, the camming mechanism 63 may be automatically activated in at least two ways or modes: when the paper 58 edge approaches the small diameter roller 62, or continuously, but only during the time the belt 10 is rotating for making copies. The former will obviously result in a smaller average or accumulated stress, but the latter may be more straightforward to implement, and require less frequent hardware movements, and will not present any difficulties with potentially affecting image registrations.

As shown, stripping is preferably downwardly from a lower flight of the belt 10, to provide post-stripping sheet separation gravity assistance, especially for thin, flimsy, sheets. However, the stripping position could also be upwardly from an upper flight of the belt, especially for a top transfer system.

It will be appreciated that the developer unit may be aligned to [evenly spaced from] the deformed (stripping) position of the belt 10 by roller 62 to avoid contact with any images being developed even during stripping. Alternatively, the image generation timing can be arranged so that there is an inter-document (no image) belt area over the developer units whenever the stripping roller 62 is activated. Another alternative is to have the stripping area on a belt bight between supporting rollers which bight is not shared with the developer units by providing another, intermediate, belt supporting roller between the developer units and the stripping area. Photoreceptor belts with three or more supporting rollers supporting the belt in a generally triangular, trapezoidal, or other configuration are well known in the art.

Returning to the other, conventional, features of the exemplary reproduction apparatus 8, after stripping, the sheet 58 moves on a conventional conveyor which advances the sheet to a conventional fusing station F, which includes a fuser assembly 64, which permanently affixes the transferred powder image to sheet 58. Preferably, fuser assembly 64 comprises a heated fuser roller 66 and a pressure roller 68. After fusing, another baffle or chute guides the advancing sheets 58 to an output catch tray 65 for subsequent removal from the printing machine 8 by the operator. It will be appreciated, however, that a finishing device (not shown) of a known type may be positioned at the sheet output for collation and/or stapling or other binding of the sheets. It will further be understood that the sheet 58 may be conventionally inverted and returned for duplex (second side) imaging by a duplex path (not shown).

As the belt 10 moves on after the sheet of support material is so separated from the photoconductive surface, the residual toner particles thereon may be exposed to a corona from a preclean charging device 72 to assist removal therefrom at cleaning station E, where a vacuum assisted electrostatic brush cleaner unit 70 may be provided. Subsequent to cleaning, a discharge lamp conventionally floods the photoconductive surface with light to dissipate any residual electrostatic charge remaining prior to the belt surface charging for the successive imaging cycle at station A again.

The overall control of the printer 8 is desirably by a conventional controller 100, which is preferably a programmed microprocessor, as discussed above, conventionally interconnected with a user interface panel 110 which provides for user interaction with the printing machine 8. Controller 100 in this example is also operatively connected with a memory storage device 120 for storing and recalling print jobs or other information in a conventional manner. As noted, controller 100 also appropriately controls the voltage sources 45, 46, 47 and 48 biasing the developer housings, and the image output terminal B, in this case ROS 26, which images the photoconductive surface, and the various above-noted corona generating devices. The controller 100 also conventionally keeps track of machine 8 operating functions and conditions, including when the printer is being utilized, when the belt 10 needs to be driven, when copy sheets are to be fed, etc.. Conventional sheet sensors, such as 102, are operatively connected to controller 100, as is a belt 10 seam sensor, such as 103. Signals therefrom (and programed time delays in controller 100) may desirably be utilized for timing the actuations at the appropriate times of solenoid 63 to activate stripping roller 62 being cammed into the belt 10, so as to avoid the belt seam and so as to deflect the belt only when needed for stripping and/or only when copies are being made, as discussed.

The foregoing description is sufficient for purposes of the present application to illustrate the general operation of an exemplary electrophotographic printing machine incorporating one example of features of the present invention therein.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In an electrographic printing system with a rotatable photoreceptor imaging belt which is adversely life affected by mechanical wrapping stresses from wrapping the photoreceptor belt around small radii supports over time, an improved system for stripping copy sheet image substrates from the photoreceptor imaging belt at a sheet stripping area in which said copy sheet image substrates are stripped from the outside surface of said photoreceptor belt at a small radius arcuate sheet stripping area of said photoreceptor belt; the improvement comprising:

operatively mounting said photoreceptor belt in said printing system only on relatively large radius belt supports which do not wrap said belt in any small radii;

said belt supports all having a sufficiently large belt engagement radii to not induce substantial said mechanical wrapping stresses in said belts;

automatically temporarily engaging the inside surface of said photoreceptor belt only during copy sheet printing with a stripping member of a smaller radius than any of said large radius belt supports with sufficient engagement force to temporarily arcuately deform a small arc segment portion of said photoreceptor belt in a correspondingly small radius to define said small radius arcuate sheet stripping area at said portion of said photoreceptor belt so deformed by said small radius stripping member; and automatically removing said small radius stripping roller from said deforming engagement with said photoreceptor belt when said photoreceptor belt is not being used for said copy sheet image substrates so as not to induce substantial said mechanical wrapping stresses in said photoreceptor belt.

2. The electrophotographic printing system of claim 1, wherein said small radius stripping member is moved into said temporary engagement with said photoreceptor belt only when said electrophotographic printing system is operating with said rotatable photoreceptor belt being rotated.

3. The electrophotographic printing system of claim 1, wherein said small radius stripping member is moved into said engagement with said photoreceptor belt only when a copy sheet image substrate to be stripped is approaching said sheet stripping area.

4. The electrophotographic printing system of claim 1, wherein said belt supports comprise at least two large diameter rollers both having substantially larger radii than said small radius stripping member.

5. The electrophotographic printing system of claim 1 in which said small radius stripping member temporarily deforms said photoreceptor belt in said sheet stripping area by a small distance for a belt wrap angle substantially less than 45 degrees and belt wrap diameter of approximately 20 mm or less.

6. The electrophotographic printing system of claim 1, wherein said small radius stripping member is a roller having a diameter of less than approximately 20 mm; and said large diameter belt supports comprise rollers all having a diameter of greater than approximately 25 mm.

7. The electrophotographic printing system of claim 1, wherein said small radius stripping roller is automatically disengaged from said photoreceptor belt whenever a belt seam passes said sheet stripping area.

8. The electrophotographic printing system of claim 1, wherein said stripping is provided after said copy sheet image substrates are at least partially charge neutralized by detacking means.

9. In an electrographic printing system with a rotatable photoreceptor imaging belt which is adversely life affected by mechanical wrapping stresses from wrapping the photoreceptor belt around small radii supports over time, an improved system for stripping copy sheet image substrates from the photoreceptor imaging belt as a sheet stripping area in which said copy sheet image substrates are stripped from the outside surface of said photoreceptor belt at a small radius arcuate sheet stripping area of said photoreceptor belt; the improvement comprising:

large radius belt supports operatively supporting said photoreceptor belt in said printing system for rotation thereon, all of which belt supports have belt engaging radii large enough not to wrap the belt in any small high belt stressing radii;

a small radius stripping member of a substantially smaller belt engaging radii than said belt supports;

an automatic camming system for temporarily engaging the inside surface of said photoreceptor belt with said small radius stripping member only during copy sheet printing with a stripping member of a smaller radius than any of said large radius supports with sufficient engagement force to temporarily arcuately deform a small arc segment portion of said photoreceptor belt in a correspondingly small radius to define said small radius arcuate sheet stripping area at said portion of said photoreceptor belt so deformed by said small radius stripping member; and said automatic camming system automatically retracting said small radius stripping member from said deforming engagement with said photoreceptor belt when said electrophotographic printing apparatus is not in use.

10. The electrophotographic printing apparatus of claim 9 in which said small radius stripping member temporarily deforms said photoreceptor belt by substantially less than 45 degrees.

11. The electrophotographic printing apparatus of claim 9, wherein said small radius stripping member is moved into said engagement with said photoreceptor belt by said automatic camming system only when said electrophotographic printing system is stripping copy sheet image substrates from said photoreceptor belt.

12. The electrophotographic printing apparatus of claim 9, wherein said small radius stripping member is automatically moved into said engagement with said photoreceptor belt only when a copy sheet image substrate to be stripped is approaching said sheet stripping area.

13. The electrophotographic printing apparatus of claim 9, wherein said belt supports comprise two large diameter rollers having substantially larger radii than said small radius stripping member.

14. The electrophotographic printing apparatus of claim 9, wherein said stripping is provided after said copy sheet image substrate is at least partially charge neutralized by detacking means.

15. The electrophotographic printing apparatus of claim 9, wherein said small radius stripping member has a belt engaging diameter of approximately 20 mm or less; and said belt supports all having a belt engaging diameter of greater than approximately 50 mm.

16. The electrophotographic printing apparatus of claim 9, wherein said photoreceptor belt has a belt seam, further comprising means for automatically disengaging said small radius stripping roller from said photoreceptor belt whenever a belt seam passes said sheet stripping area.

* * * * *